US005342172A

United States Patent [19]

Coudray et al.

[11] Patent Number: 5,342,172

[45] Date of Patent: Aug. 30, 1994

[54] COOLED TURBO-MACHINE VANE

[75] Inventors: Xavier G. A. Coudray, Fontainebleau; Mischaël F. L. Derrien, Savigny Le Temple; Philippe M. P. Pichon, Fontainebleau, all of France

[73] Assignee: Societe Nationale d'Etude et de Construction de Moteurs d'Aviation "SNECMA", Paris, France

[21] Appl. No.: 36,685

[22] Filed: Mar. 25, 1993

[30] Foreign Application Priority Data

Mar. 25, 1992 [FR] France ..... 92 03583

[51] Int. Cl.[5] ..... F01D 5/18

[52] U.S. Cl. ..... 416/97 R; 416/97 A; 416/95

[58] Field of Search ..... 416/90 R, 95, 96 R, 416/96 A, 97 R, 97 A

[56] References Cited

U.S. PATENT DOCUMENTS

| | | | |
|---|---|---|---|
| 3,533,711 | 10/1970 | Kercher | 416/90 |
| 4,168,938 | 9/1979 | Dodd | 416/97 R |
| 4,500,258 | 2/1985 | Dodd et al. | 416/96 R |
| 4,653,983 | 3/1987 | Vehr . | |
| 4,770,608 | 9/1988 | Anderson et al. | 416/97 R |
| 5,215,431 | 6/1993 | Derrien | 416/97 R |

FOREIGN PATENT DOCUMENTS

| | | | |
|---|---|---|---|
| 0473991 | 3/1992 | European Pat. Off. . | |
| 1601561 | 12/1970 | Fed. Rep. of Germany . | |
| 1601730 | 9/1970 | France . | |
| WO/8901564 | 2/1989 | PCT Int'l Appl. . | |
| 2066372 | 7/1981 | United Kingdom . | |
| 2077364 | 10/1981 | United Kingdom | 416/95 |
| 2184492 | 6/1987 | United Kingdom . | |

OTHER PUBLICATIONS

Patent Abstracts of Japan, vol. 7, No. 137 (M-222)(1282), Jun. 15, 1983, JP-A-58 051 202, Mar. 25, 1983.

*Primary Examiner*—Edward K. Look
*Assistant Examiner*—Mark Sgantzos
*Attorney, Agent, or Firm*—Oblon, Spivak, McClelland, Maier & Neustadt

[57] ABSTRACT

A turbo-machine vane having a plurality of internal cavities for the flow of a cooling fluid, and a plurality of openings through the outer wall of the vane for communicating the internal cavities with the outside of the vane. Two rows of openings are provided in the leading edge of the vane, one row on each side of the central line of the leading edge end extending parallel with the central line, and each opening of each row is oriented to direct cooling fluid which flows through it from the interior of the vane away from the central line relative to the rows.

6 Claims, 8 Drawing Sheets

COOLED TURBO-MACHINE VANE

BACKGROUND OF THE INVENTION

1. Field of the Invention

The present invention is directed to a cooled turbomachine vane.

2. Discussion of the Background

The performance of a gas turbine is closely dependent upon the temperature of the gases entering the turbine, and the guide vanes of the turbine are obviously the parts which are subjected to the highest temperatures.

In spite of continual improvements in the behaviour of metals at very high temperatures, it is now no longer possible to envisage increasing the temperature of the gases entering the turbine without providing arrangements for cooling the vanes of the turbine, particularly said guide vanes.

SUMMARY OF THE INVENTION

It is an object of the invention to provide an improved arrangement enabling turbine vanes to withstand increased temperatures.

According to the invention there is provided a turbomachine vane comprising an outer wall defining a hollow interior, a plurality of internal walls dividing said hollow interior into a plurality of internal cavities for the flow of a cooling fluid, and means defining a plurality of openings in said outer wall communicating at least some of said internal cavities with the outside of said vane, said vane having a foot end and a head end and defining a longitudinal axis between said foot end and said head end, and said outer wall defining an intrados face, an extrados face and a leading edge portion of said vane separating said intrados face and said extrados face, said leading edge portion having a central line on which tangents to said outer wall and lying in planes perpendicular to said longitudinal axis of said vane are perpendicular to the principal direction of the flow of gases which, in use, come into contact with said vane, wherein said plurality of openings include two first rows of openings in said leading edge portion of said vane on opposite sides of said central line and substantially parallel to said central line, the orientation of each opening in said two first rows being such as to direct cooling fluid which flows through said opening from said interior of said vane away from said central line relative to said rows, and each said opening of said two first rows having a cross-section of oblong shape arranged at an angle relative to said central line, wherein said plurality of internal cavities include a first longitudinal passage in the region of said leading edge of said vane and in direct communication with said openings of said two first rows of openings, a first series of longitudinal ducts adjacent and defined partly by the portion of said outer wall defining said intrados face of said vane, and a second series of longitudinal ducts adjacent and defined partly by the portion of said outer wall defining said extrados face of said vane, and wherein means are provided on the longitudinal ducts of said first and second series which are nearest said leading edge of said vane for promoting turbulance in the flow of cooling fluid therein.

Preferably, each opening in said two first rows of openings is oriented relative to said longitudinal axis of said vane such that the inner end of said opening is closer to said foot of said vane than the outer end of said opening, whereby cooling fluid which flows through said opening is also directed away from said foot towards said head of said vane.

Preferably, the cross-section of each opening in said two first rows of openings increases in size from the inner end of said opening to the outer end thereof.

Preferably, said plurality of openings also include two second rows of openings extending substantially parallel to said central line said two second rows of openings being arranged on opposite sides of said two first rows of openings, and the openings of said two second rows also communicating with said first longitudinal passage. In this case, each opening of the two second rows of openings preferably has a cross-section of oblong shape which extends substantially parallel to the central line.

Preferably, said plurality of internal cavities include a second longitudinal passage which is separated from said first longitudinal passage, said second longitudinal passage communicating with at least some of said longitudinal ducts of said first and second series of longitudinal ducts so as to be supplied with cooling fluid from said longitudinal ducts, and said plurality of openings include openings in said extrados face of said vane which communicate with said second longitudinal passage.

The second longitudinal passage may be defined partly by the portion of the outer wall defining the extrados face of the vane and partly by some of the internal walls of the vane, or it may be defined solely by one of the internal walls which is separate from the outer wall and forms a removable jacket having a closed section.

Preferably, at least some of said internal cavities are provided with a cooling fluid inlet situated either at the foot end of the vane or at the head end, and in this connection all of the longitudinal ducts are preferably provided with such a cooling fluid inlet.

The main advantage of vanes which are constructed in accordance with the invention is that they may be subjected to temperatures higher than can be withstood by known vanes, thus making it possible to construct turbines which perform better than existing turbines.

The invention will now be described further in relation to a number of preferred embodiments, which are given by way of example only, and with reference to the accompanying drawings.

DESCRIPTION OF THE PREFERRED EMBODIMENT

The various vanes illustrated each have a longitudinal axis AB which, when said vane is secured in position in a turbine, extends in a substantially radial direction with respect to the rotational axis of the turbine. The letter A of the axis AB corresponds to the inner or foot end of the vane, and letter B corresponds to the outer or head end of the vane.

Figure 1:
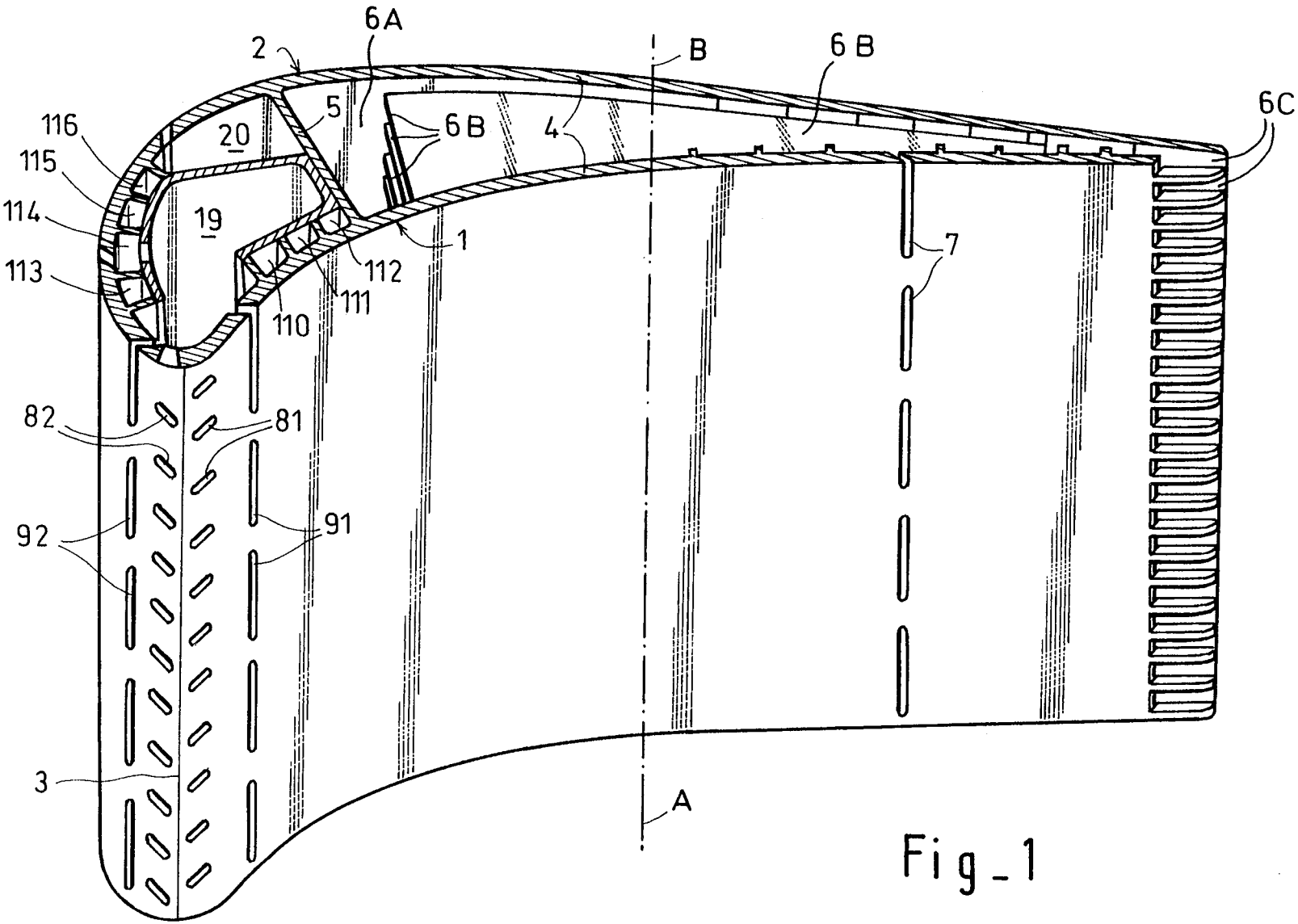
FIG. 1 is a partly perspective, partly sectional view of a first embodiment of a vane in accordance with the invention.
Figure 2:
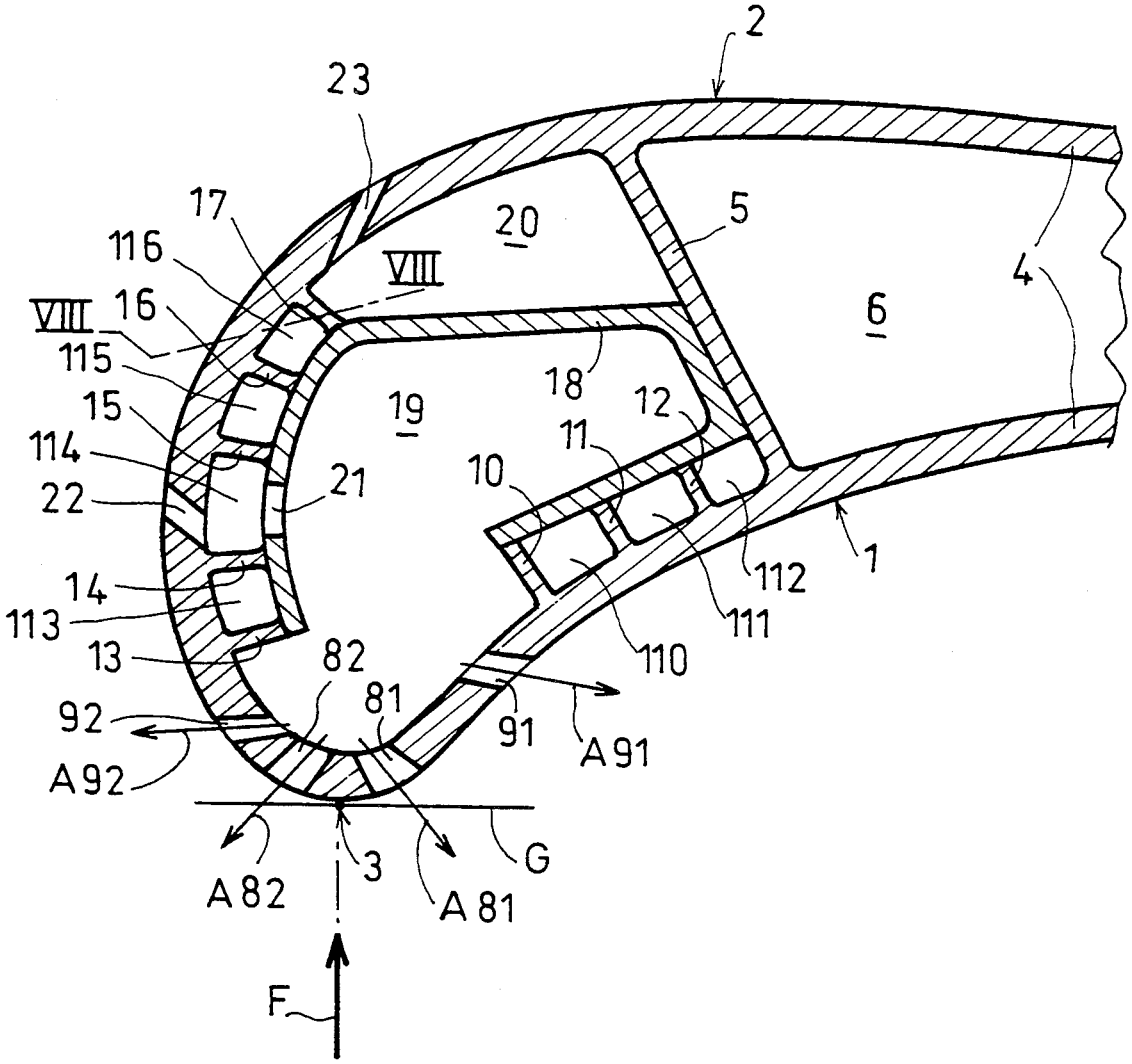
FIG. 2 is a cross-sectional view of part of the vane shown in FIG. 1, taken along line II—II of FIG. 3.
Figure 3:
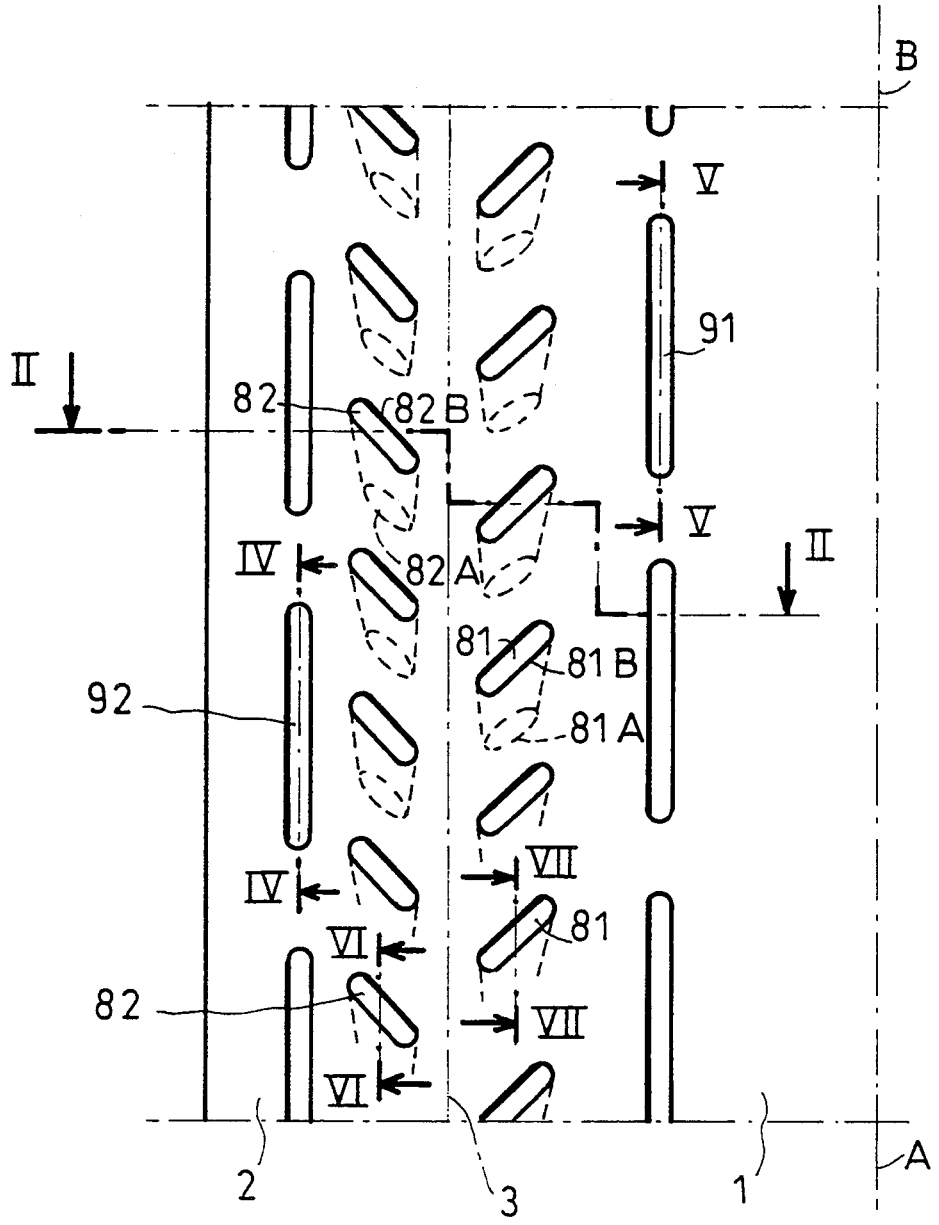
FIG. 3, is an elevational view looking in the direction of the arrow F in FIG. 2.
Figure 4:
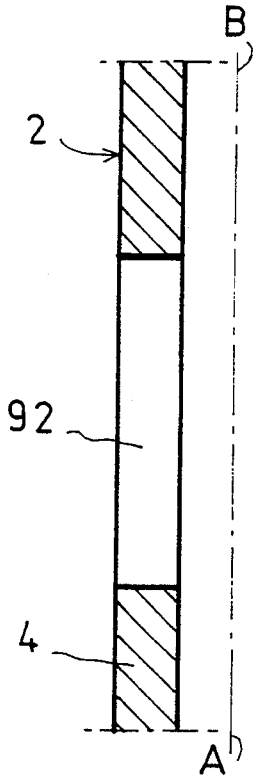
FIGS. 4, 5, 6 and 7 are sections taken along lines IV—IV, V—V, VI—VI and VII—VII respectively in FIG. 3.
Figure 5:
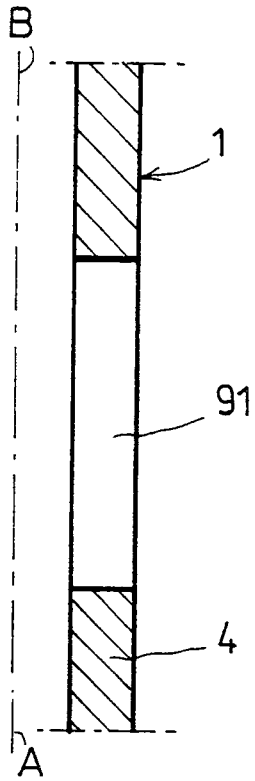
Figure 6:
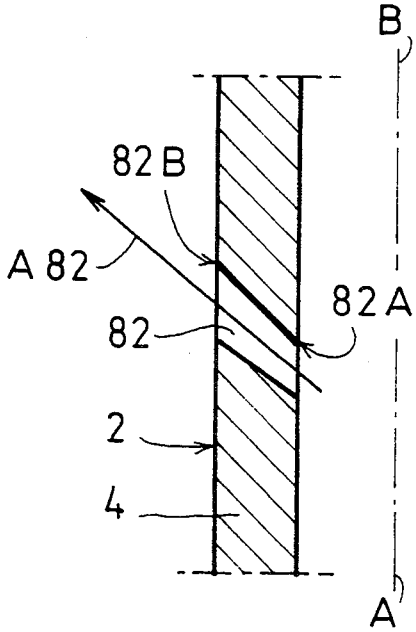
Figure 7:
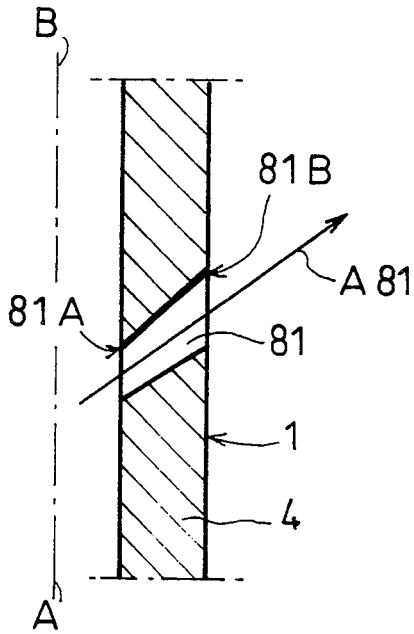
Figure 8:
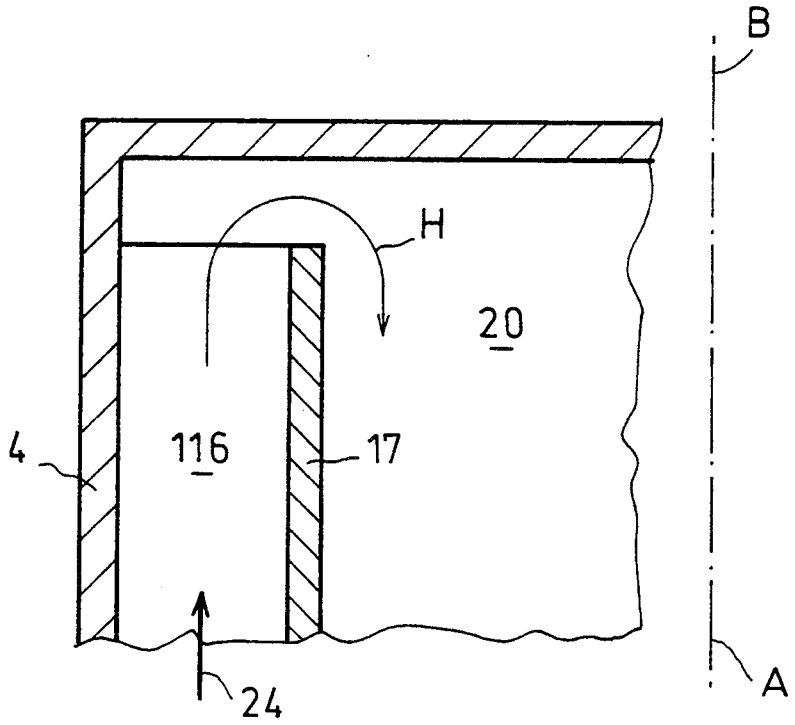
FIG. 8 is a section taken along line VIII—VIII in FIG. 2.

The vane shown in FIGS. 1 to 8 has a face 1 defining the intrados face, and a face 2 defining the extrados face of the vane, the two faces being separated by the leading edge of the vane which has a central line 3 substantially parallel to the longitudinal axis AB. The arrow F in FIG. 2 represents the general direction of flow of the gases when the vane is fitted in a turbine, and G represents the direction of the tangent to the vane at the center 3 of the leading edge in each cross-section of the vane taken perpendicular to the axis AB and is orthogonal to the direction F of the gas flow.

The vane is hollow and has an outer wall 4 and a first internal wall 5 which interconnects the two mutually spaced parts of the outer wall 4 defining the intrados face 1 and the extrados face 2.

The internal wall 5 is situated in the proximity of the leading edge 3, and on the trailing edge side of the wall 5 the vane contains a first chamber 6A communicating with a stack of mutually spaced plates 6B arranged substantially perpendicular to the axis AB. The lower part of the chamber 6A also communicates with a cooling fluid inlet. The spaces between the plates 6B communicate with the outside of the vane-through a row of slits 7 which are substantially parallel to the axis AB and are located in the part of the outer wall 4 defining the intrados face 1, and also through slits 6C opening at the trailing edge of the vane. The cooling fluid entering the chamber 6A thus escapes from this chamber through the slits 7 and 6C.

The leading edge of the vane is formed by two relatively narrow areas of the wall 4 situated on opposite sides of the central line 3, and is provided with two first rows of openings 81 and 82 which pass through the wall 4. The openings 81 are situated in the part of the wall 4 which defines the intrados face 1, and the openings 82 are situated in the part of the wall 4 which defines the extrados face 2. Each row of the openings 81 and 82 extends substantially parallel to the axis AB and the central line 3, with the individual openings, which have an oblong shape, arranged at an angle to the central line 3 as shown. Beyond the first rows of openings 81, 82 with respect to the central line 3 and immediately adjacent the leading edge there are two second rows of openings 91 and 92 also passing through the outer wall 4 and extending substantially parallel to the axis AB and the central line 3. The openings 91 are situated in the part of the wall 4 defining the intrados face 1, and the openings 92 are situated in the part of the wall defining the extrados face 2.

Beyond the row of openings 91 with respect to the leading edge, the vane has a number of longitudinal inner walls 10, 11, 12 extending perpendicularly from the inside face of the outer wall 4. Similarly, beyond the row of openings 92 relative to the leading edge, the vane has further longitudinal inner walls 13, 14, 15, 16 and 17 extending perpendicularly from the inner face of the outer wall 4. An interconnecting internal wall 18 is welded to the edges of the various inner walls 10, 11, 12, 13, 14, 15, 16 and 17, as well as to the internal wall 5, and defines, together with the outer wall 4 a plurality of longitudinal ducts 110, 111, 112, 113, 114, 115 and 116, a first longitudinal cavity 19 with which the openings 81, 82, 91 and 92 communicate, and a second longitudinal cavity 20. The internal walls 10, 11, 12 are integral with the part of the outer wall 4 defining the intrados face 1, and the walls 13, 14, 15, 16 and 17 are integral with the part of the outer wall 4 defining the extrados face 2.

Each of the openings 81 has a double orientation. The axis A81 of each opening 81 is firstly oriented obliquely with respect to the direction G such that, moving from the first cavity 19 towards the outside of the vane, it is directed away from the central line 3 relative to the row of the openings 81. Secondly, in this embodiment the axis A81 is oriented obliquely with respect to the direction of the longitudinal axis AB, having a component directed from the foot end A towards the head end B of the vane. Each opening 81 opens at its inner end 81A into the cavity 19, and at its outer end 81B to the outside of the vane, the inner end 81A being situated below the outer end 81B (i.e. nearer the foot end A of the vane). Moreover, in the embodiment shown, the cross-section of each opening 81 increases from its inner end 81A to its outer end 81B. A point on the outer rim of the opening which is the counterpart of a point on the inner rim is further away from the foot end of the vane than said point on the inner rim. In other words, the axis A81 has a component which is parallel to and extends in the same direction as the longitudinal axis AB.

Similarly, each of the openings 82 also has a double orientation. The axis A82 of each opening 82 is firstly oriented obliquely relative to the direction G such that, moving from the first cavity 19 towards the outside of the vane, it is directed away from the central line 3 relative to the row of the openings 82. Secondly, the axis A82 is also oriented obliquely relative to the direction of the longitudinal axis AB, having a component directed from the foot end A towards the head end B of the vane. Each opening 82 opens at its inner end 82A into the cavity 19, and at its outer end 82B to the outside the vane, the inner end 82A being below the outer end 82B (i.e. nearer the foot end A of the vane). Moreover, in the embodiment shown, the cross-section of each opening 82 increases from its inner end 82A to its outer end 82B. A point on the outer rim of the opening which is the counterpart of a point on the inner rim is further away from the foot end of the vane than the said point on the inner rim. In other words, the axis A82 has a component which is parallel to and proceeds in the same direction as the longitudinal axis AB.

It should be noted, however, that the second orientations of the axes A81 and A82 having components parallel to the axis AB could alternatively be oriented from the head end B towards the foot end A of the vane, or the axes A81 and A82 may be orthogonal to the axis AB. As will be described later, the cavity 19 and the ducts 110, 111, 112, 113, 114, 115, 116 are intended to be supplied with a pressurized cooling fluid through fluid inlets situated either in the region of the foot end of the vane A, or in the region of the head end B. The choice of whether the second orientations of the axes A81 and A82 having components parallel to the axis AB are directed towards the head end or the foot end of the vane naturally depends on whether the cooling fluid is admitted into the foot end or the head end of the vane.

Also, as a further alternative, the cross-section of each opening 81, 82 may be constant between the inner end 81A, 82A and the outer end 81B, 82B.

Each of the openings 91, 92 is formed by an elongated slit substantially parallel to the longitudinal axis AB. In the embodiment of FIGS. 1 to 7, the openings 91 are aligned on the same straight line as each other, and the openings 92 are similarly aligned on a common straight line. Furthermore, the axes A91 and A92 of the openings 91, 92 which are directed from within the cavity 19 to the outside of the vane have a component oriented in a direction which is away from the leading edge and the first rows of openings 81, 82 (as shown in FIG. 2).

The duct 114 adjacent the duct 113 nearest to the openings 92 communicates with the first longitudinal cavity 19 through openings 21 in the wall 18, and with the outside of the vane through openings 22 in the portion of the wall 4 defining the extrados face 2.

The duct 113 nearest to the openings 92 and the duct 110 nearest to the openings 91 are both fitted with means, such as disturbers (not shown), for promoting turbulence in the flow of cooling fluid.

The second longitudinal cavity 20 communicates with the outside of the vane through openings 23 in the portion of the outer wall 4 defining the extrados face 2. Moreover, the ducts 110, 111, 112, 113, 115, 116 are arranged so as to be connected at their ends nearest the foot (A) of the vane with a supply of cooling fluid 24, and open at their ends nearest the head (B) of the vane into the second longitudinal cavity 20 (as represented by the arrow H in FIG. 8). The cavity 19 is also provided with a cooling fluid inlet in the region of the foot A of the vane.

Figure 9:
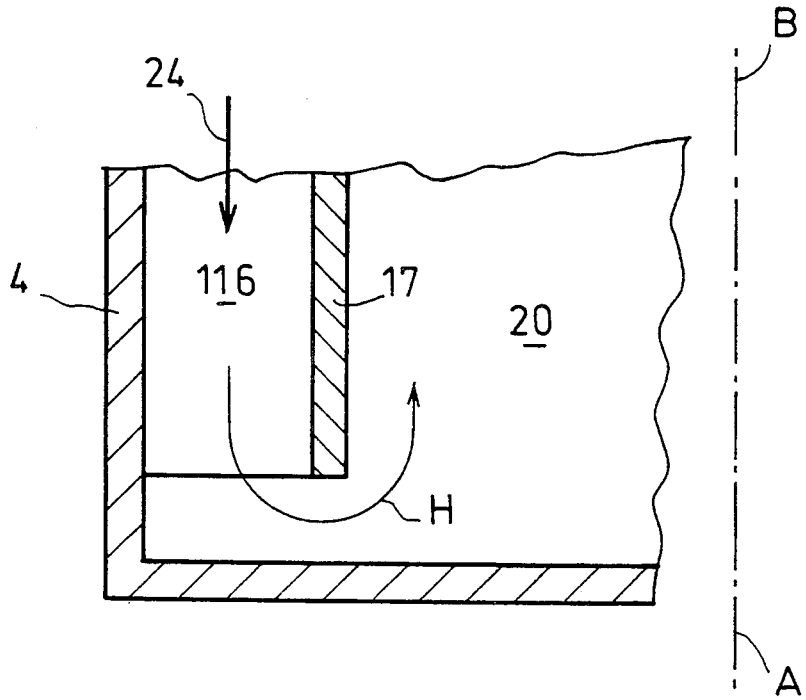
FIG. 9 is a section similar to that of FIG. 8, but at the foot of the vane in an alternative embodiment.

However, as has already been indicated, the ducts 110 to 116 and the cavity 19 may alternatively be supplied with cooling fluid 24 through an inlet which is situated in the region of the head B of the vane. In this case the ducts open into the second cavity 20 at their ends closest to the foot A of the vane, as shown in FIG. 9.

Figure 10:
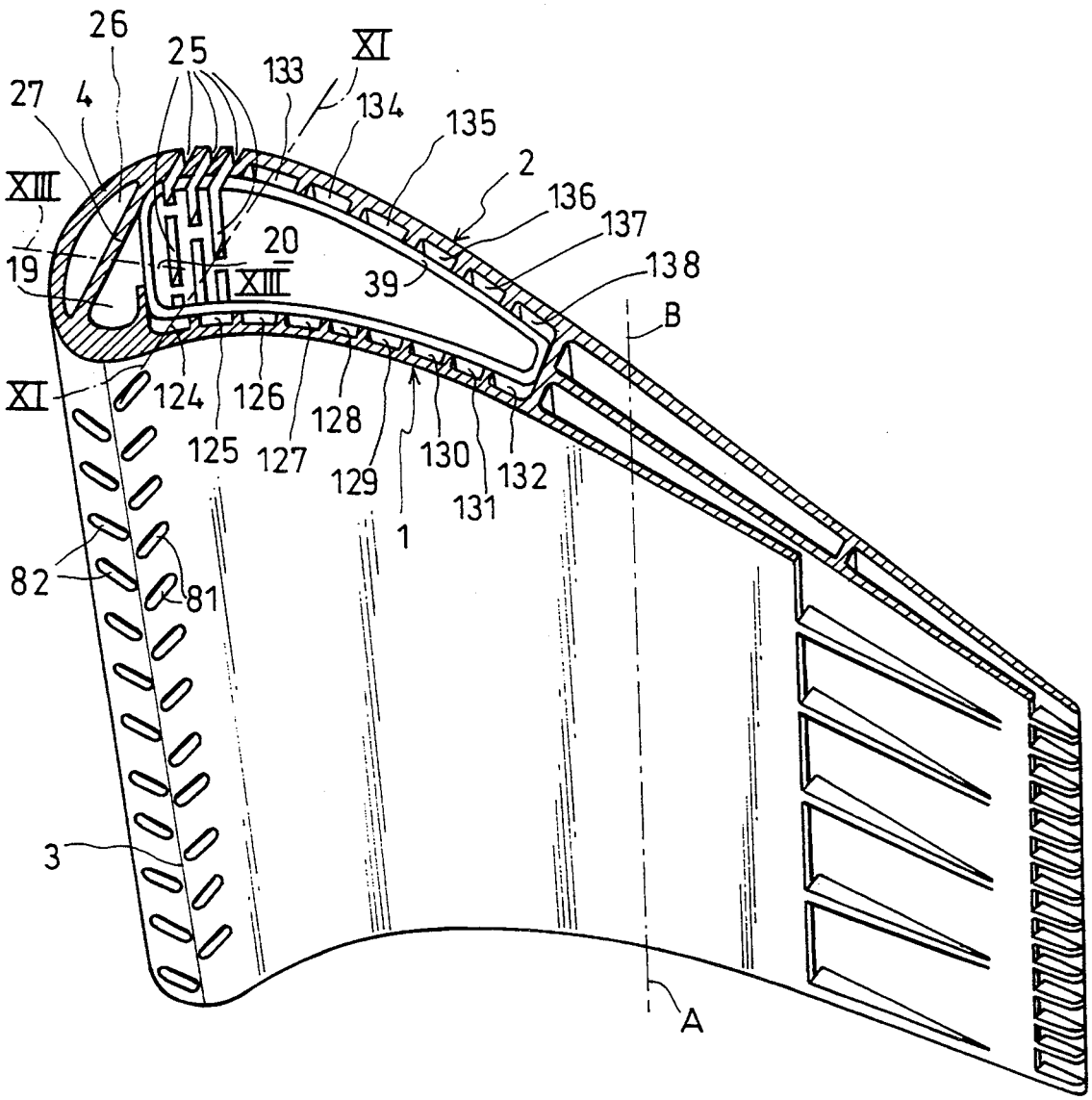
FIG. 10 is a partly perspective partly sectional view of another embodiment of a vane in accordance with the invention.
Figure 11:
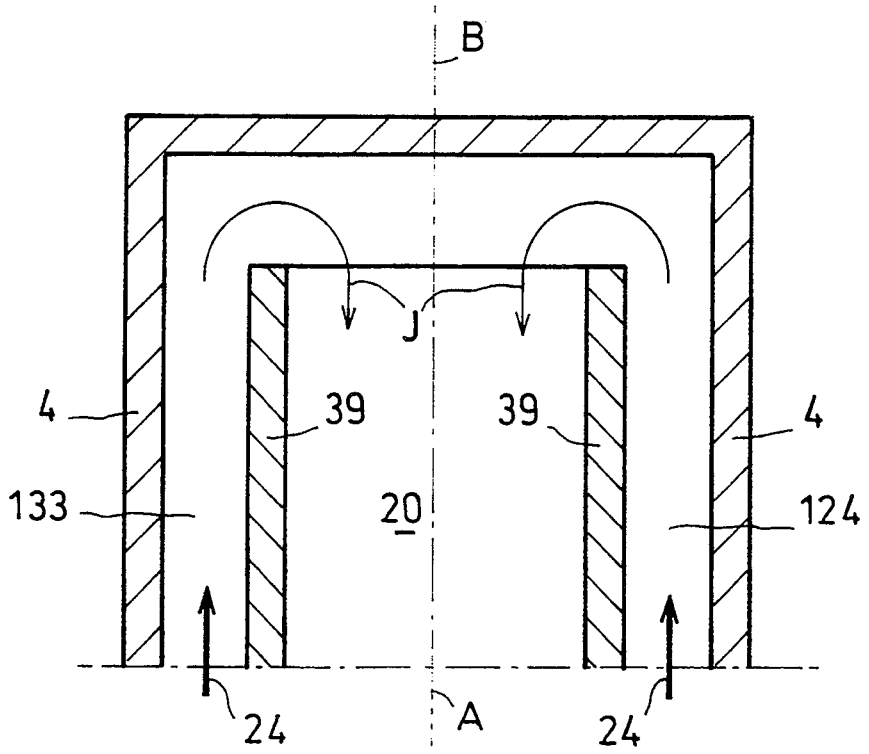
FIG. 11 is a section taken along line XI—XI in FIG. 10.

In the vane shown in FIG. 10, only the two first rows of openings 81, 82 are in communication with the first longitudinal cavity 19, and the second longitudinal cavity 20 is defined entirely by a removable jacket 39 of closed section which fits within the vane and, in sealing contact with small longitudinal walls integral with the inside face of the outer wall 4, defines a plurality of longitudinal ducts 124, 125, 126, 127, 128, 129, 130, 131, 132, 133, 134, 135, 136, 137, 138, Openings 25 are provided through the wall of the jacket 39 and the outer wall 4 to establish communication between the second longitudinal cavity 20 and the outside of the vane. It should be noted that the first longitudinal cavity 19 and the ducts 124 to 138 are arranged to receive a cooling fluid 24 at their ends near the foot end (A) of the vane, while the ducts 124 to 138 communicate with the second longitudinal cavity 20 at their ends near the head (B) of the vane as indicated by the arrows J in FIG. 11.

Figure 13:
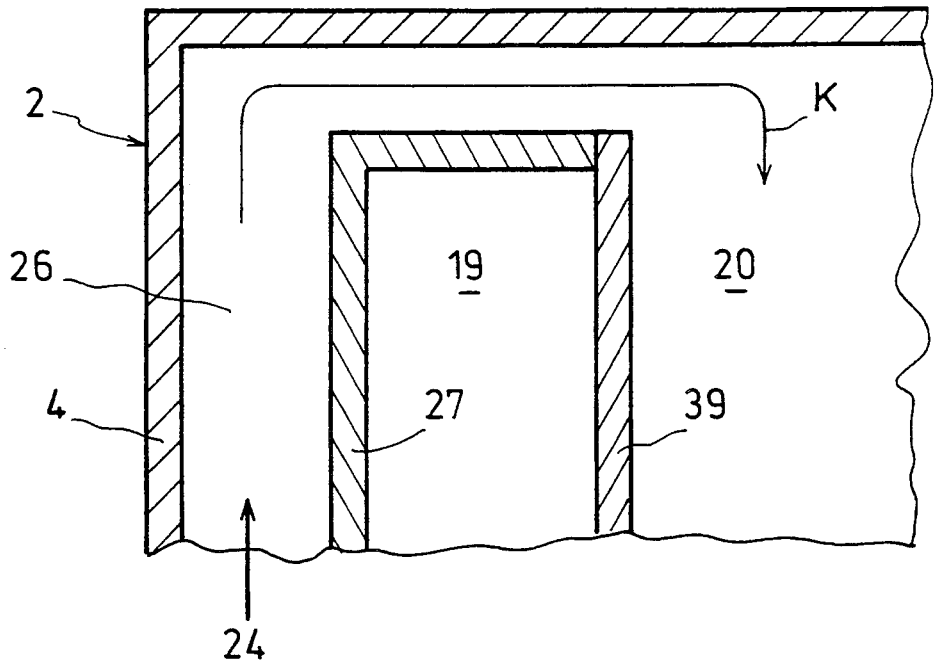

In this embodiment a third longitudinal cavity 26 is defined by a part of the outer wall 4 defining the extrados face 2 and by an internal wall 27 which separates this third cavity 26 from the first longitudinal cavity 19. This third cavity 26 is arranged to receive the cooling fluid 24 in the region of the foot A of the vane, and communicates with the second cavity 20 in the region of the head B of the vane as shown in FIG. 13.

Figure 12:
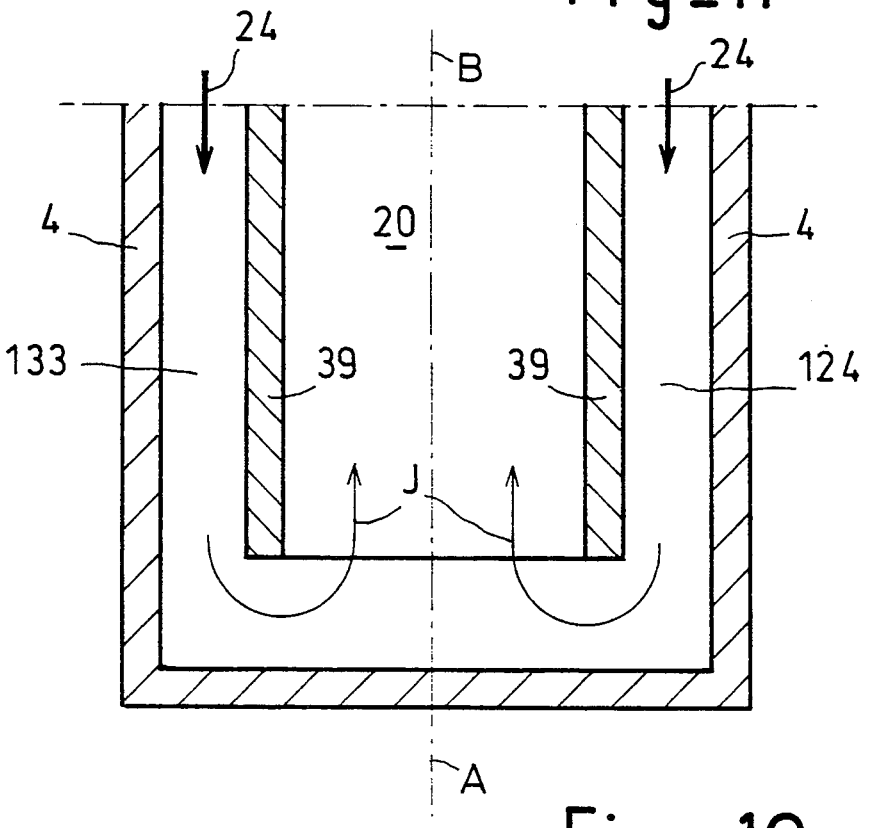
FIG. 12 is a section similar to that of FIG. 11, but at the foot end of an alternative embodiment; and, FIG. 13 is a section taken along line XIII—XIII in FIG. 10.

As in the embodiment of FIGS. 1 to 8, it is possible, as an alternative, to reverse the positions of the cooling fluid inlets and the communications with the second cavity 20. FIG. 12 shows such an alternative, in which the cooling fluid 24 in the various ducts 124 to 138 and the third cavity 26 is received in the region of the head B of the vane, and the said ducts and the third cavity 26 communicate with the second cavity 20 at the foot A of the vane as shown by the arrows J. Here also, however, the choice between receiving fluid at the head or at the foot of the vane is dependent on the orientation (direction BA or direction AB)of the axes of the openings 81, 82.

The outer wall 4 of the vane shown in FIGS. 1 to 8 is well cooled, and as a result is able to be exposed to very high temperatures, this ability being one of the conditions for obtaining a turbo-machine with a high performance and output.

The cooling of the wall 4 at the places most exposed to high temperatures, i.e. the area of the leading edge on the intrados face side 1 and the extrados face side 2, is effected firstly by the films of cooling fluid exiting through the openings 81, 82 and is completed, in the embodiment of FIG. 1 to 8, by the films of cooling fluid exiting through the openings 91, 92. The orientations of the axes A81 and A82 of the openings 81, 82 cause the cooling fluid to be directed towards the intrados face 1 and the extrados face 2 respectively, and to cover the whole of these faces with a film of the cooling fluid from the foot A of the vane as far as the head B of the vane, or, in the alternative of FIG. 9, from the head to the foot of the vane.

The areas of the wall 4 situated beyond the openings 81, 82, 91, 92 of FIGS. 1 to 8, or the openings 82, 82 of FIG. 10, are cooled by the flow of the cooling fluid in the ducts 110, 111, 112, 113, 115, 116 or 124 to 138. This fluid, after passing into the second longitudinal cavity 20 and escaping through the openings 23 of FIG. 2, or 25 of FIG. 10, also forms a further film cooling the part of the extrados face 2 substantially opposite the leading edge.

Also, in the embodiment of FIGS. 1 to 8, the fluid which exits through the openings 22, provides an effective cooling film in an area of the extrados face which in part is substantially parallel to the general direction F of the gas flow.

It should also be noted that the means for promoting turbulence in the flow of the cooling fluid with which the ducts 110 and 113 are provided, give this fluid enough time to cool effectively those areas of the outer wall 4 which are nearest the leading edge and are particularly exposed to the high temperatures of the hot gases.

Air will be most often used as the cooling fluid, but it will be understood that the invention is not limited to the use of air for the cooling. Furthermore, the invention is not restricted to the embodiments which have been described, but is intended to cover all alternatives which may be selected without departing from the scope or spirit of the invention.

We claim:

1. A turbo-machine vane, comprising:

an outer wall defining a hollow interior, a plurality of internal walls dividing said hollow interior into a plurality of internal cavities for the flow of a cooling fluid, and said outer wall having a plurality of openings for communicating at least some of said internal cavities with the exterior of said vane, said vane having a foot end and a head end and defining a longitudinal axis between said foot end and said head end, and said outer wall defining an intrados face, an extrados face and a leading edge portion of said vane separating said intrados face and said extrados face, said leading edge portion having a central line on which tangents to said outer wall and lying in planes perpendicular to said longitudinal axis of said vane are perpendicular to the principal direction of the flow of gases which, in use, come into contact with said vane, wherein said plurality of openings include two first rows of openings in said leading edge portion of said vane on opposite sides of said central line and substantially parallel to said central line, the orientation of each opening in said two first rows being such as to direct cooling fluid which flows through said opening from said interior of said vane away from said central line relative to said rows, and each said opening of said two first rows having a cross-section of an oblong shape arranged at an angle relative to said central line, wherein said plurality of internal cavities include a first longitudinal cavity in the region of said leading edge of said vane and in direct communication with said openings of said two first rows of openings, a first series of longitudinal ducts adjacent and defined partly by the portion of said outer wall defining said intrados face of said vane, and a second series of longitudinal ducts adjacent and defined partly by the portion of said outer wall defining said extrados face of said vane wherein each opening in said two first rows of openings is oriented relative to said longitudinal axis of said vane such that the inner end of each of said openings is closer to said foot of said vane than the respective outer end of each of said openings such that cooling fluid which flows through said openings is directed away from said foot toward said head of said vane and wherein the cross-section of each of said openings in said first two rows of openings increases uniformly in side from the inner end of said opening to the outer end thereof.

2. A vane according to claim 1, wherein said plurality of openings also include two second rows of openings extending substantially parallel to said central line, said two second rows of openings being arranged on opposite sides of said two first rows of openings, and the openings of said two second rows also communicating with said first longitudinal passage.

3. A vane according to claim 2, wherein each opening of said two second rows of openings has a cross-section of oblong shape which extends substantially parallel to said central line.

4. A vane according to claim 1, wherein said plurality of internal cavities include a second longitudinal passage which is separated from said first longitudinal cavity, said second longitudinal cavity communicating with at least some of said longitudinal ducts of said first and second series of longitudinal ducts so as to be supplied with cooling fluid from said longitudinal ducts, and said plurality of openings include openings in said extrados face of said vane which communicate with said second longitudinal cavity.

5. A vane according to claim 4, wherein said second longitudinal cavity is defined partly by said portion of said outer wall defining said extrados face of said vane and partly by some of said internal walls of said vane.

6. A vane according to claim 4, wherein said second longitudinal cavity is defined solely by one of said internal walls of said vane, said one internal wall being separate from said outer wall and forming a removable jacket having a closed section.

* * * * *

UNITED STATES PATENT AND TRADEMARK OFFICE

CERTIFICATE OF CORRECTION

PATENT NO. : 5,342,172

DATED : August 30, 1994

INVENTOR(S) : Xavier G. A. COUDRAY et al.

It is certified that error appears in the above-indentified patent and that said Letters Patent is hereby corrected as shown below:

Column 2, line 9, after "line" insert --,--.

Column 5, line 54, change "138," to --138.--.

Column 8, line 14, change "passage" to --cavity--.

Signed and Sealed this

Fifteenth Day of August, 1995

*Attest:*

*Attesting Officer*

BRUCE LEHMAN

*Commissioner of Patents and Trademarks*